US005944488A

United States Patent [19]

Matson

[11] Patent Number: 5,944,488

[45] Date of Patent: Aug. 31, 1999

[54] SNAP-IN GUARD FAN ASSEMBLY

[75] Inventor: Carl G. Matson, Little Rock, Ark.

[73] Assignee: Triangle Engineering of Arkansas, Inc., Jacksonville, Ark.

[21] Appl. No.: 08/900,233

[22] Filed: Jul. 24, 1997

Related U.S. Application Data

[63] Continuation-in-part of application No. 08/646,917, May 8, 1996, abandoned.

[51] Int. Cl.[6] ..... F04D 29/64

[52] U.S. Cl. ..... 416/247 R; 415/121.2

[58] Field of Search ..... 416/247 R, 63, 416/170 R, 244 R; 415/121.2, 124.2, 213.1, 214.1; 417/362, 234; 474/113, 114, 115, 132, 133

[56] References Cited

U.S. PATENT DOCUMENTS

| | | | |
|---|---|---|---|
| 2,735,611 | 2/1956 | McLean | 417/362 |
| 4,239,459 | 12/1980 | Felter | 417/234 |
| 4,242,055 | 12/1980 | Felter | 417/362 |
| 4,865,289 | 9/1989 | Lawson | 474/132 |
| 5,348,447 | 9/1994 | Redetzke | 416/247 R |
| 5,441,391 | 8/1995 | Frost et al. | 417/362 |

FOREIGN PATENT DOCUMENTS

| | | | |
|---|---|---|---|
| 579687 | 6/1933 | Germany | 416/247 R |

*Primary Examiner*—F. Daniel Lopez
*Assistant Examiner*—Richard Woo
*Attorney, Agent, or Firm*—Stephen D. Carver

[57] ABSTRACT

A tube axle fan assembly comprising a tubular housing and resiliently deformable, convex guards that removably, snap fit to each fan end. A motor and associated components are mounted in the housing upon a bracket having two spaced-apart feet that form a triangular brace. A pivoted bracket mounts the motor such that the pull of gravity tends to tighten the drive belt entrained about the pulleys. The housing comprises a cylindrical, hollow body having input and output ends with diameters smaller than the guard outside diameter. A reinforcing channel is formed in each end of the housing to retain the seated guard. Each guard comprises a circular wire frame that assumes a dome-like configuration. Each guard has a series of radially spaced-apart spokes emanating from a central hub which must be arched to clear the smaller diameter of the housing. The spokes are reinforced by a continuous wire spiral that circumscribes the hub. The guards may be resiliently removed from the channel by exerting an outward force on a spoke that causes the central hub to flex outwardly while the radial spokes deform from their seated positions. A tool for removing and installing guards comprises an elongated shaft having a forked end and a spaced-apart hooked end.

3 Claims, 11 Drawing Sheets

SNAP-IN GUARD FAN ASSEMBLY

CROSS REFERENCE TO RELATED APPLICATION

This application is a continuation-in-part of Ser. No. 08/646,917, filed May 8, 1996 on behalf of inventor Carl G. Matson, entitled Improved Fan Assembly and Guard System, which is now abandoned.

BACKGROUND OF THE INVENTION

1. Field of the Invention

The present invention relates generally to portable industrial ventilation fans. More particularly, my invention relates to a "snap together" heavy duty fan whose guards are stressed when fitted to the housing to reinforce the overall structure.

2. Description of the Prior Art

Fans that are capable of moving large volumes of high velocity air are used in many cooling applications. High velocity fans often provide the only cooling for workers in typical industrial plants. To practically control the effects of such cooling, it is desirable to control the direction, velocity, and volume of the air being driven. Often these fans are mishandled, dropped, or subjected to other damaging forces through carelessness and the like. The long term structural durability of such fans is of paramount importance.

I have previously proposed a fan that controls and directs air over long ranges. U.S. Pat. No. 5,480,282, issued on Jan. 2, 1996, and its teachings are hereby incorporated by reference. The prior art comprises many different fans. Most industrial designs use an elongated, tubular housing enclosing a multi-bladed fan driven at relatively high velocity. They are often referred to as "tube-axle" designs. Tube-axle fans have several advantages. They are durable and rugged. They are relatively uncomplicated and easy to build. However, such fans can be noisy and they tend to vibrate, with vibration intensity often increasing over time. Loud, continuous rattles are annoying and distracting. Further, vibration can eventually loosen critical parts causing misalignment or premature breakdown.

One cause of fan vibration relates to the drive belts employed with belt driven fans. Over time typical V-belts will eventually wear and deform. Thereafter the tension transmitted by the belt between the axis of rotation of the fan blades and the drive motor axis will vary in response to rotation. An annoying oscillating effect can result. The resultant vibration causes fan shaking and noise. Direct drive motors may ameliorate the problem of worn or distorted drive belts, but such motors are costly, and they present other problems.

"Tube-axle" fans often have their housing edges reinforced with a structural angle. Alternatively they may have a simple angle fluted or rolled into the material at the edge of each housing end. These reinforced edges lend rigidity to the housing and provide an anchor for the necessary safety guards that cover the blades. Typical guards are normally screwed or bolted to the housing edges using conventional, radially spaced apart fasteners (i.e., nuts and bolts). The fan design described in my aforementioned patent requires twenty four such fastener combinations for mounting the guards. Obviously this is reflected in the labor and material cost of production. Another disadvantage is that the fasteners may loosen and fall off over time in response to continued vibration. Further it has been found that such guard mounting techniques do not maximize structural integrity.

Conventional guards screw-mounted through the normal procedure can eventually vibrate loose.

Several own prior art manufacturing processes may be used to fashion housing bodies with reinforced edges. However, known procedures inevitably entail expensive set-ups that make the changing of housing sizes difficult. Moreover, even though metal forming is a common procedure that works well to produce the housing body itself, subsequent rolling of the body into a desirable cylindrical housing shape is less precise. Since the desired cylindrical shape is difficult to achieve, distorted, somewhat non-circular ends result. Nonuniform tube ends make it difficult install conventional guards. Typical guards have an unyielding, circular shape that requires a consistent cylindrical housing for proper assembly. There are also numerous holes that must be properly aligned in the guard and the tube edge during assembly.

Furthermore, motor mounting brackets generally will not fit an out-of-round housing properly. As may well be imagined, difficulties shaping the housing body into a consistent cylindrical form and resultant guard and mounting bracket attachment problems may easily compromise the quality of the produced fan.

Another vexatious problem with conventional industrial fans involves structural deformation. Over time, internal stresses and dynamic forces generated during normal operation can misshape the fan, distorting the housing from the optimum round cross section. Many industrial fans are portable, and they are roughly moved about as necessary for spot cooling. Generally, such portable fans comprise external wheels mounted to the housing and a handle for conveniently pushing the fan to a desired location. Known prior art fans are not designed to maximize structural strength. They fail to adequately compensate for stresses exerted by the motors and other internal components upon the housing during movement. Their guards fail to make a maximum contribution to structural integrity.

Finally, a problem with conventional fan housings involves the numbers of components that must be handled during assembly and maintenance. Conventional guards and guard attachment devices require handling and installing several parts during manufacture as well as removing a corresponding number during routine maintenance. Also, most conventional mounting brackets use several components pieces that require considerable assembly time. Such brackets are often difficult to handle and store.

SUMMARY OF THE INVENTION

My improved fan overcomes several of the above referenced problems with known prior art fans. The preferred fan assembly and guard system comprises a rigid, generally cylindrical tubular housing having a pair of snap-fitted "quick connect" guards "stress coupled" to each end. As the guards are snap fitted and mated to tube channels on opposite fan ends, they deform and assume a convex geometry. When so mounted, the guards stress and thus reinforce the entire fan assembly. It has less parts, it is more stable, it vibrates less, and it is quieter and stronger than prior art designs.

The generally tubular housing forms a cylinder having an air input end and an air output end. The housing rests upon a pair of external wheels and a cooperative exterior stand. An electrical motor, a belt-driven driven propeller, and associated connections are mounted within the housing upon an internal, balancing bracket having two spaced-apart ends. The bracket attaches to the housing adjacent the stand at one end and adjacent the wheels at the other end. The bracket legs and the body segment between the junctures form a triangular brace. This triangular brace transfers forces and stresses generated by the internal components during fan movement to the wheels and stand of the fan, which in turn dissipate the transferred forces and stresses to the support surface (i.e., the ground).

The preferred housing is made from a flat plate rolled into a cylindrical, hollow body. The body has an air input end and an air output end. A reinforcing channel circumscribes the body at both ends of the tube. The edge initially angles toward the inside of the housing and outwardly from the body at forty-five degrees. A subsequent ninety degree angle reverses and then returns to a spaced-apart but parallel location. The two angles symmetrically cooperate during forming to help maintain the flatness of the plate. The flatness of the plate helps maintain cylindrical precision during rolling. The reinforcing channel permits the guard to be seated and unseated without harming the housing. The ninety degree angle forms a resilient retaining lip that secures the guard to the housing.

Each guard comprises an oversized, circular wire frame. A series of flexible, radially spaced-apart spokes emanate from a central hub. A wound internal, wire spiral spans the spokes, culminating with an outermost ring. When unstressed (i.e., prior to installation) the guards are circular and minimally domed. They have a diameter greater than the effective diameter of the housing tube. They are deformed during installation and stressed to assume a noticeably convex, dome like shape. They are thus snap fitted into the tube, and when this occurs, the guards change shape, and tension is uniformly distributed to the housing by the spokes. The latter phenomenon stresses the fan assembly and tends to maintain the cylindrical shape.

Normally the guards remain seated in the tube channels. Each guard may be conveniently removed from the channel and the housing during fan maintenance or as otherwise necessary. The guard is removed from the channel by exerting an abrupt "yanking" force that causes the central hub to flex outwardly. The radial spokes flex or bend as the central guard hub deforms. This bending movement permits the spoke ends to move from their seated positions in the tube channel. Then, when all spoke ends are unseated, the guard may be removed from the fan housing.

The guard may be reinstalled in the channel in a similar manner. First, several of the spoke ends are seated in the channel. Then, a downward force is exerted on each unseated spoke end to bend the guard about its hub. Again, the spokes flex about the central hub as it moves outwardly to permit insertion of each spoke end into the channel.

A tool for removing and installing the guard comprises a handle having a forked end and an oppositely hooked end. Each tine of the forked end is also hooked. To remove the guard, the hooked end is placed near the center of the guard and a yanking force exerted to remove the guard. To install the guard, the forked end is inserted into the channel and a spoke adjacent the outer ring is inserted beneath the fork juncture. Then each spoke end is forced downwardly to flex the guard about its hub while the end is seated in the channel.

A major object is thus to provide a heavy duty tube axle ventilation fan that will not deform from the optimum cylindrical shape.

Another fundamental object is to provide a tube axle ventilation fan that is highly stable.

Another object of this invention is to produce a cylindrical tube axle fan of the character described that can be quickly assembled and whose parts, once assembled, synergistically reinforce the entire apparatus to prevent the fan from becoming "out-of-round."

Yet another object of the invention is to produce a fan of the character described whose construction details lead to higher manufacturing precision. It is a feature of the invention that the structure disclosed insures a consistent cylindrical shape and maintains a circular cross section.

It is another important object of this invention to produce a fan of the character described with a pair of snap-in guards that install easier, contribute to overall strength and integrity, and which yield a rugged but esthetically attractive product.

Another important object is to provide a low vibration tube axle fan.

Another important object to this invention is to provide a frame system which concentrates forces and stresses on two points of contact with the floor in the manner described herein to reduce damages and vibration.

A related object of the present invention is to provide a mounting bracket that cooperatively forms a triangular shape with the housing to dissipate internal forces and stresses to exteriorly braced housing components.

Another fundamental object of the present invention is to produce a fan of the character described which avoids the use of multiple radially spaced apart fasteners which are otherwise used to hold on guards.

Another important object is to provide a fan of the character described which can be quickly serviced in the field without the use of screwdrivers, rivet guns and the like. It is an important feature of the invention that both guards on either side of the fan can be snapped into and out of position.

A similar object of this invention is to provide a cylindrical fan of the character described with smooth, undrilled edges which will prevent cutting or injury to workers.

A general object of this invention is to provide a fan of the character described which is easy to service in the field and which saves production time.

A still further object is to provide a fan which is readily capable of use either inside or outdoors.

Another object is to provide a fan of the character described that totally isolates all rotating blades within a safe, protected shroud to avoid direct human contact.

These and other objects and advantages of the invention, along with features of novelty appurtenant thereto, will appear and become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE DRAWINGS

Figure 1:
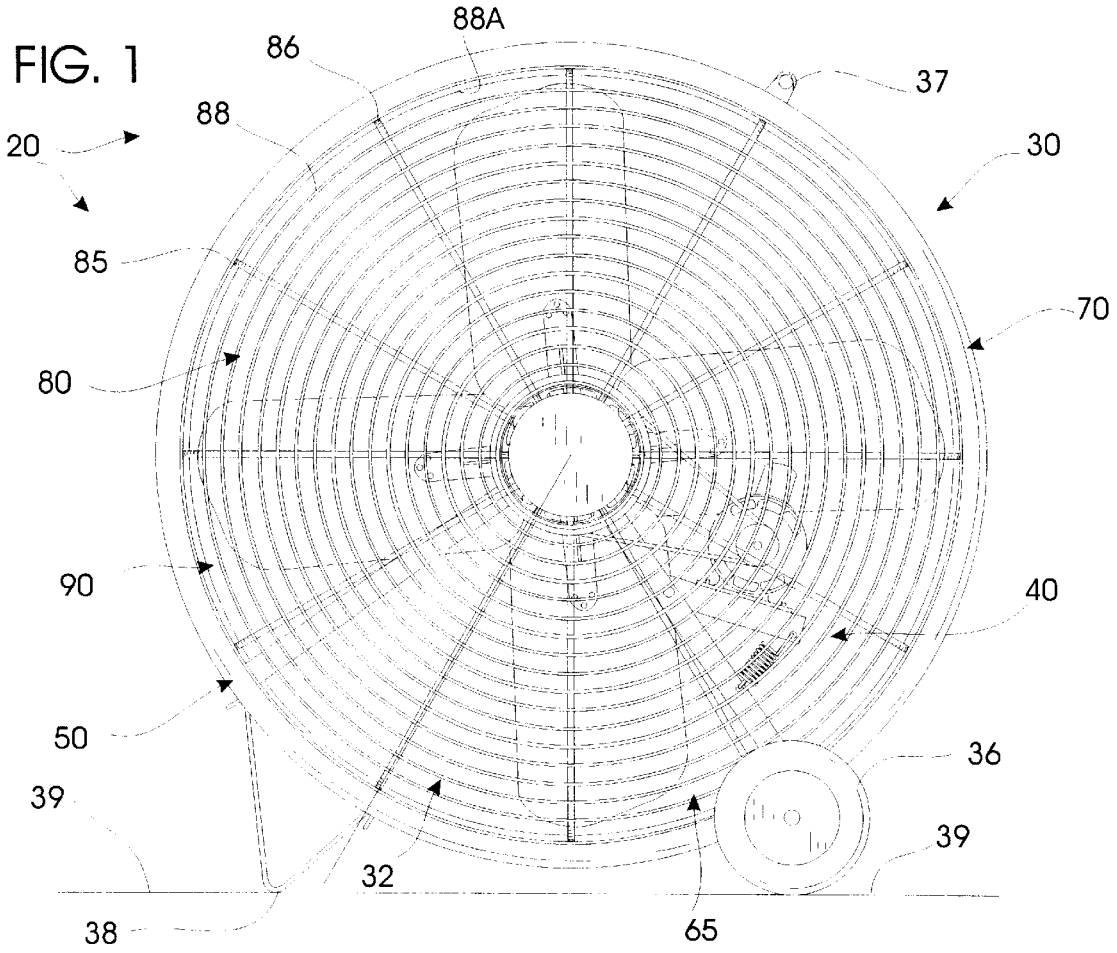
FIG. 1 is a front elevational view of a tube axle ventilating fan constructed in accordance with the best mode of the invention.
Figure 2:
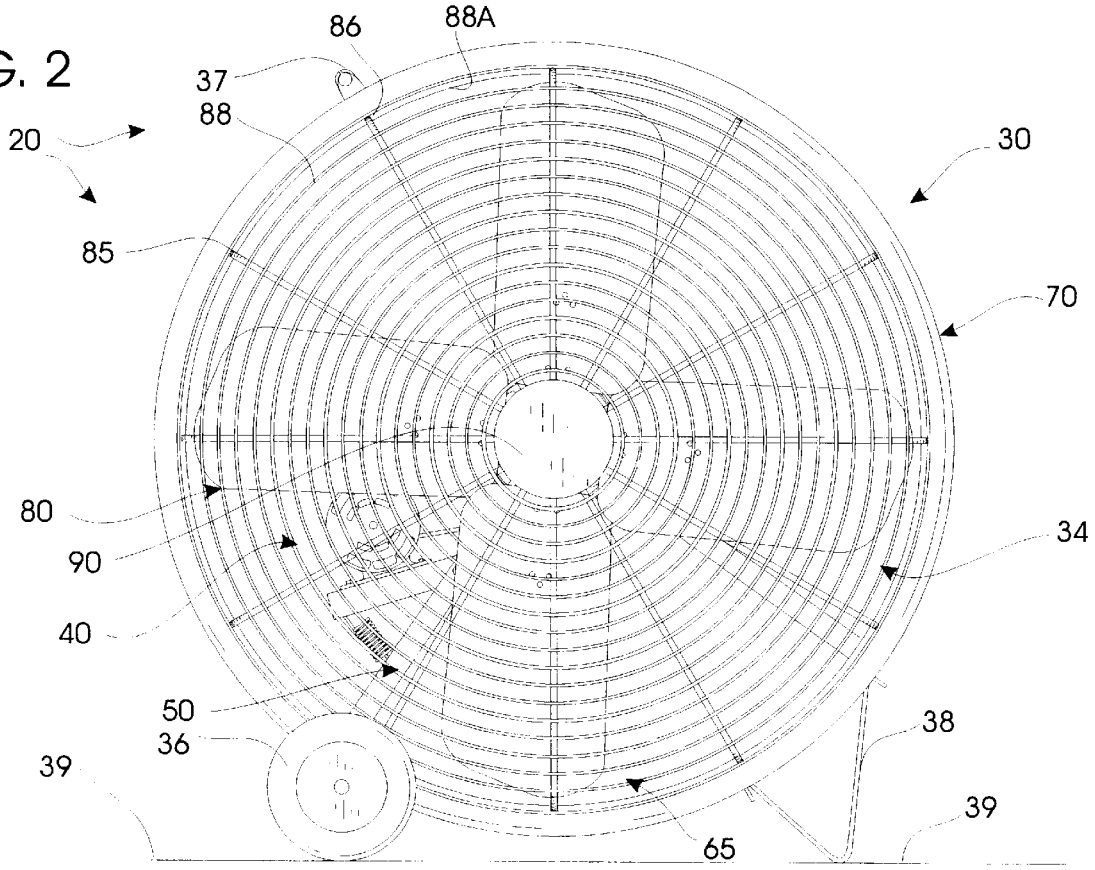
FIG. 2 is a rear elevational view of the fan.
Figure 3:
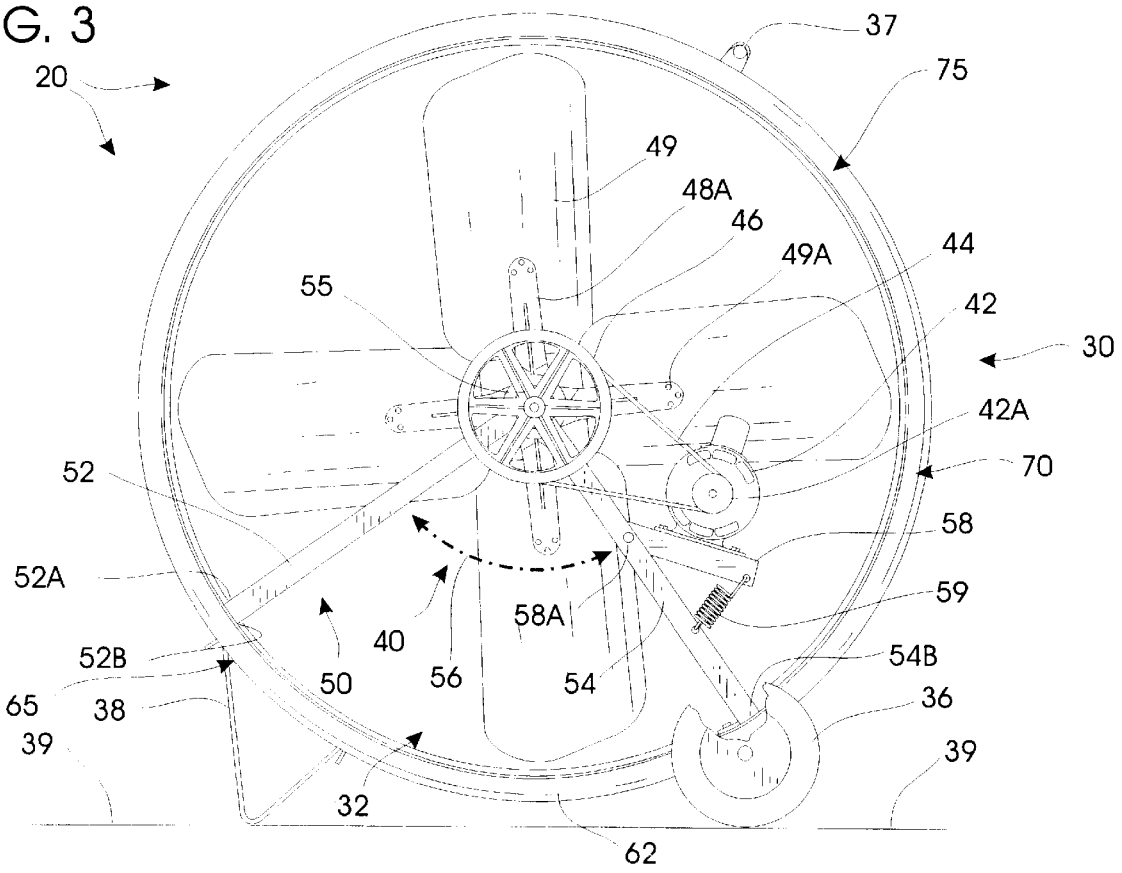
FIG. 3 is a partially fragmented, front elevational view similar to FIG. 1 with the front guard omitted for clarity.
Figure 4:
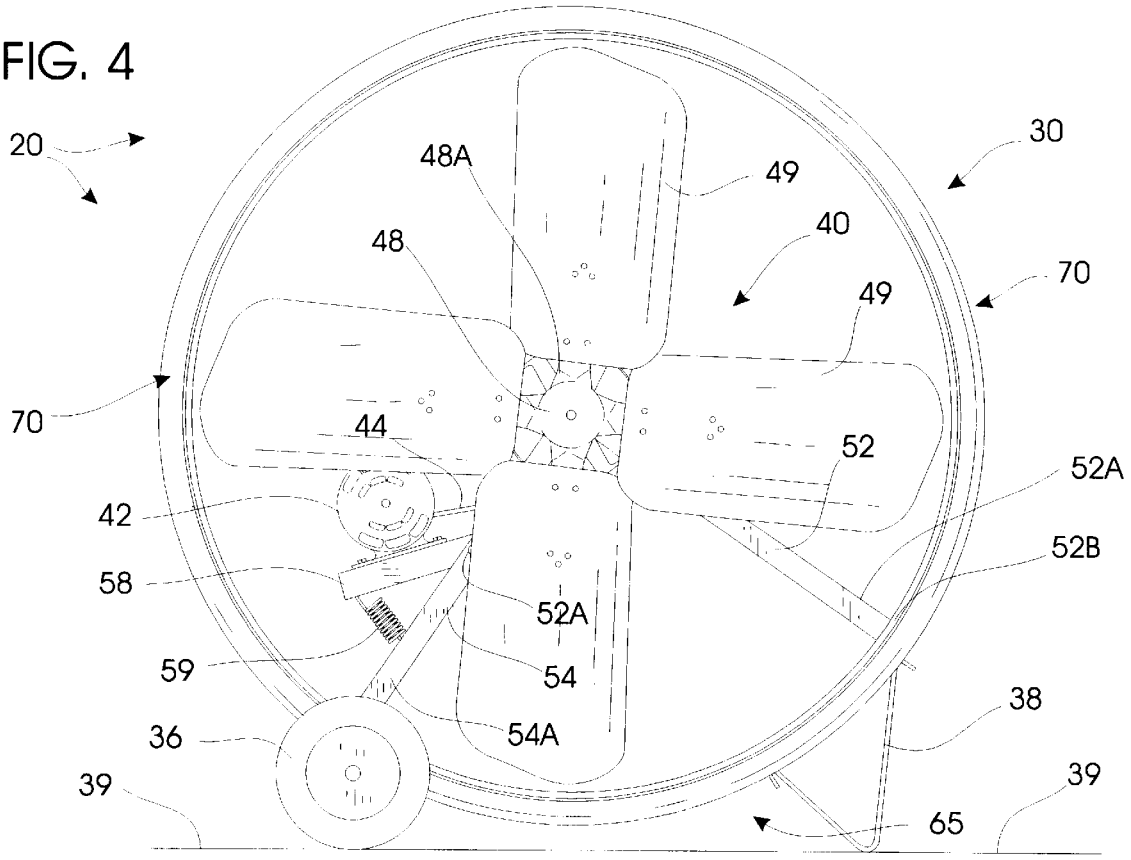
FIG. 4 is a partially fragmented, rear elevational view similar to FIG. 2 but with the rear guard omitted for clarity.

With initial reference directed to FIGS. 1–16, my improved fan assembly and guard system is generally designated by the reference numeral 20. As previously stated, improved fan 20 overcomes several perceived problems with known prior art fans involving ease of maintenance as well as durability.

Fan 20 comprises a generally tubular housing 30 having an air input end 32 and an air output end 34 (FIGS. 1–7). The housing 30 rests upon a pair of external wheels 36 and a cooperative exterior stand 38. Wheels 36 and stand 38 cooperatively support fan 20 on a selected support surface, such as ground 39. A handle 37, in conjunction with wheels 36, facilitates convenient fan movement when necessary.

Figure 5:
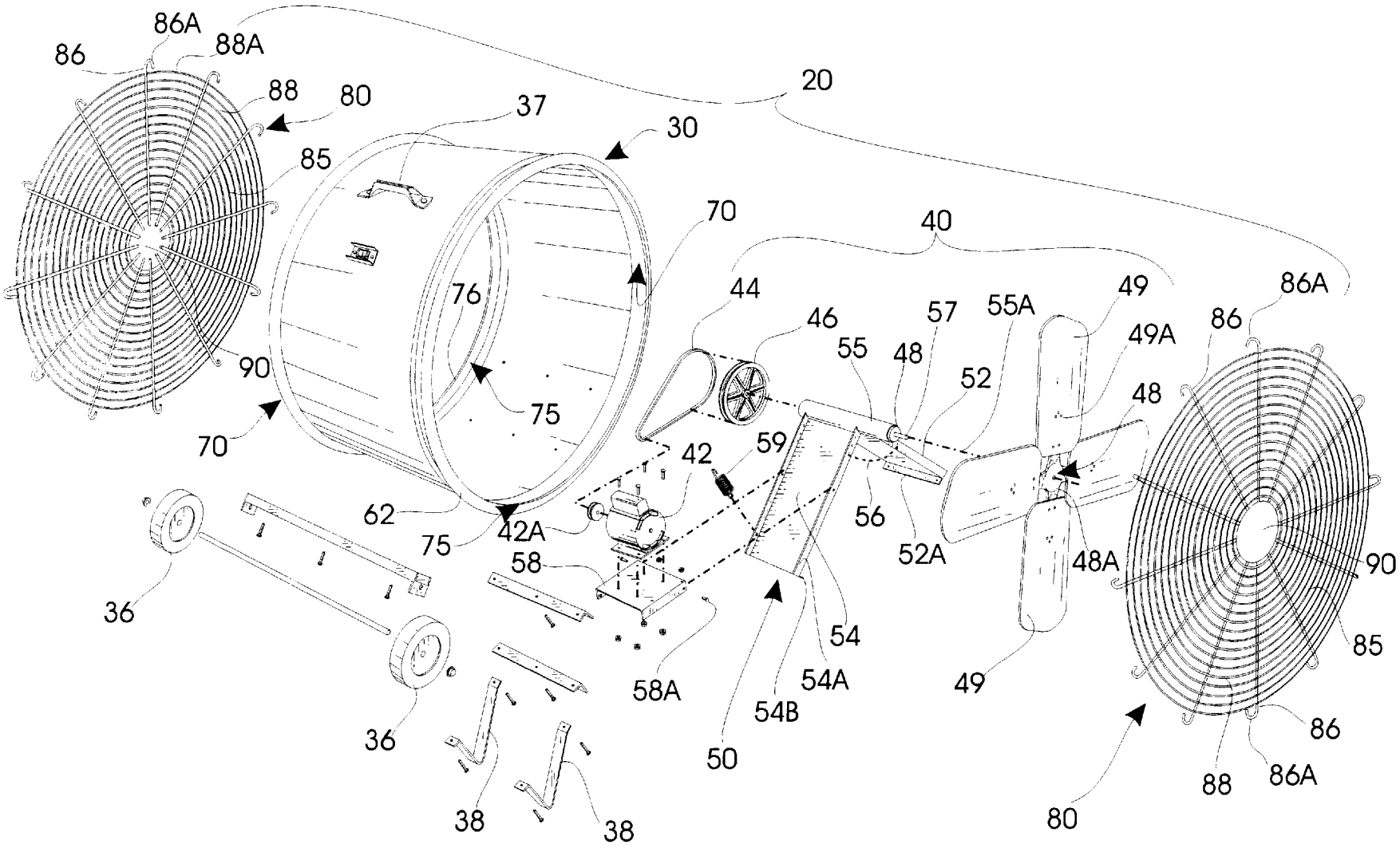
FIG. 5 is an exploded, fragmentary pictorial view of the fan housing, internal components and guard, with portions omitted or broken away for clarity.
Figure 6:
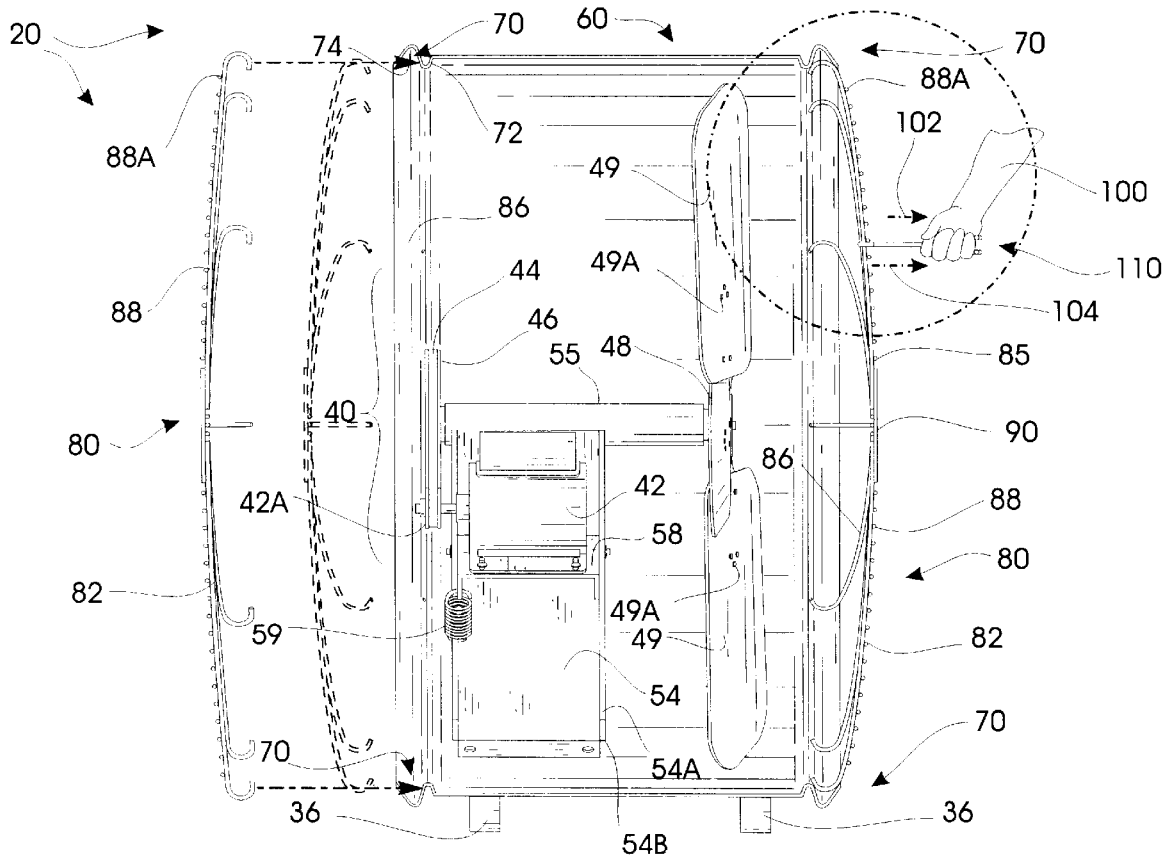
FIG. 6 is a partially fragmented, side elevational view with portions of the housing and guard omitted or broken away for clarity.
Figure 7:
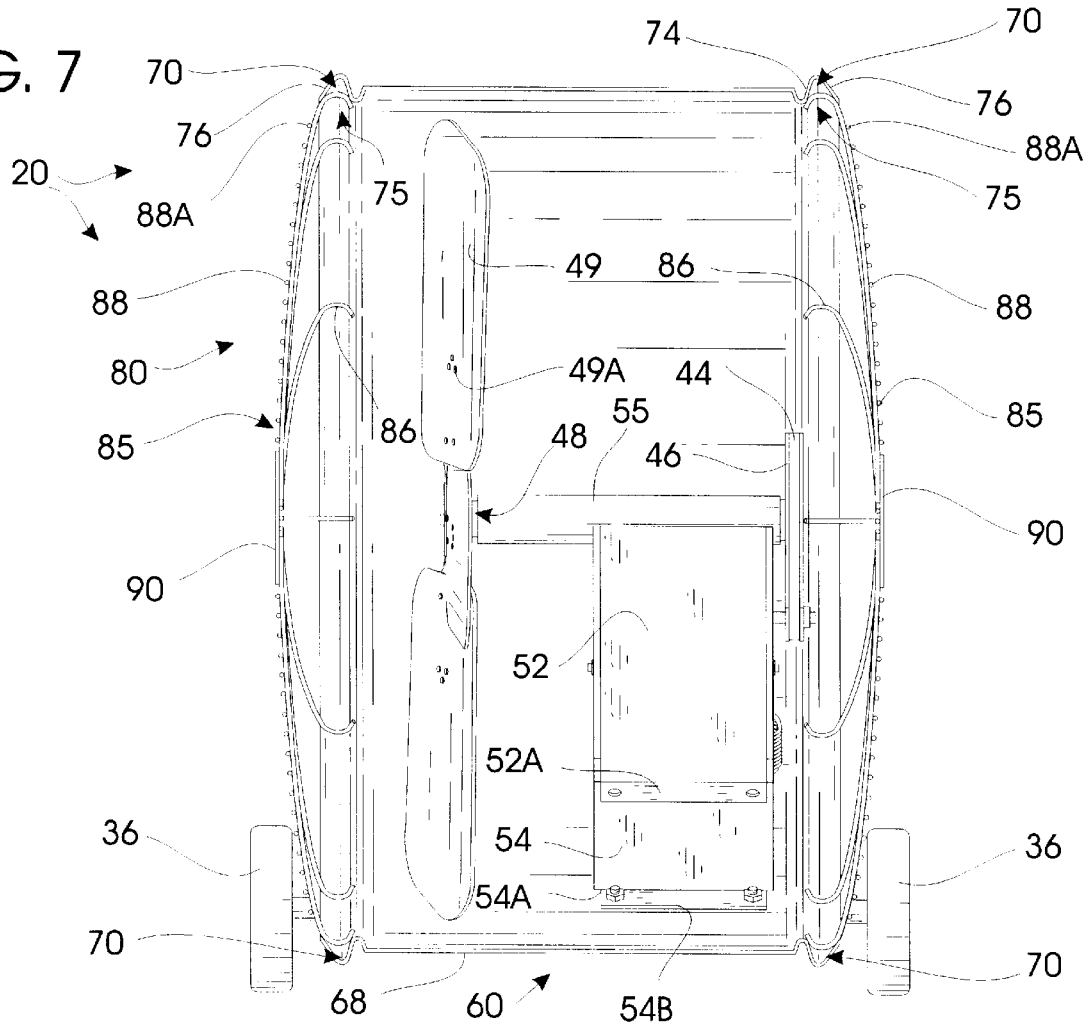
FIG. 7 is a partially fragmented, side elevational view taken from the opposite side of FIG. 6, with portions of the housing and guard omitted or broken away for clarity.

Referring primarily to FIGS. 5 and 6, housing 30 protects several internal fan components 40. The internal fan components 40 provide cooling air. An electrical motor 42 rotates drive pulley 42A. A drive belt 44 is entrained about pulleys 42A, 46 to rotate a multi-blade propeller 48. A terminal blade 49 mounts each individual propeller blade 48A via rivets 49A. The wing-shaped, internal balancing bracket 50 supports internal components 40. Bracket 50 comprises two elongated legs 52, 54 (FIGS. 5–7) that intersect at mandrel 55. The legs 52, 54 form an angle of intersection 56 that, in the best mode, is approximately ninety degrees. A motor mounting bracket 58 (FIG. 5) that supports motor 42 pivotally attaches to leg 54 via pins 58A.

Mandrel 55 (FIG. 5) mounts axle 57 that secures pulley 46. The axis of rotation 55A established by mandrel 55 is generally coincident with the longitudinal axis of the housing. Motor 42 and pulley 42A are disposed beneath mandrel 55 and pulley 46. As bracket 58 is pivotal, the weight of motor 42 pulls it downwardly against pressure from belt 44 that is entrained about the pulleys. Additional tension is provided by bracket 58 that is pulled by compensator spring 59 to maintain belt tension. As the belt deforms during the usual aging process, it may irregularly ride up and down within the pulleys, tending to vibrate the assembly. With the drive motor so mounted, the combination of the pivoted bracket 58 and the compensator spring 59 tends to dampen the oscillations otherwise produced by the rotating belt. Spring 59 thus restrains rebound that would otherwise result from belt irregularities.

The terminal feet 52A, 54A of legs 52, 54 each attach to housing 30 on body 60 at exterior 68. Terminal foot 52A attaches to body 60 adjacent to stand 38 at juncture 52B while terminal foot 54A attaches to body 60 adjacent to wheels 36 at juncture 54B. The legs 52, 54 and the body segment 62 extending between the feet 52A, 54A and corresponding junctures 52B and 54B establish a roughly triangular brace assembly 65.

Brace 65 reinforces the fan housing 30 by partially absorbing and dissipating stresses and forces during movement of fan 20. Brace 65 also helps dissipate forces and stresses generated by the internal fan components 40 during operation. Such forces or stresses are transferred along bracket 50 through body 60 to wheels 36 and stand 38. These forces and stresses are then transferred outwardly to support surface 39.

Figure 9:
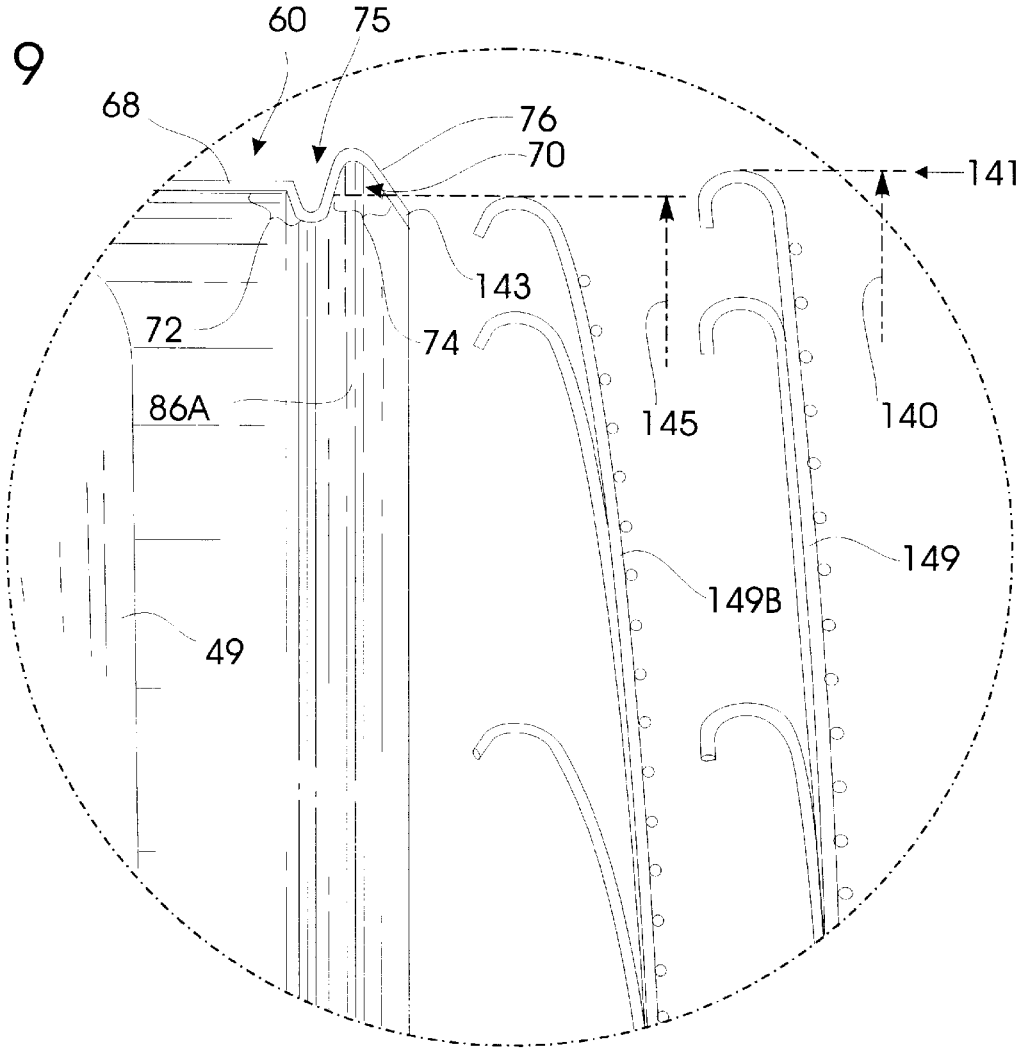
FIG. 9 is an enlarged view of the encircled portion of FIG. 6 showing the guard moving from its seated position.
Figure 11:
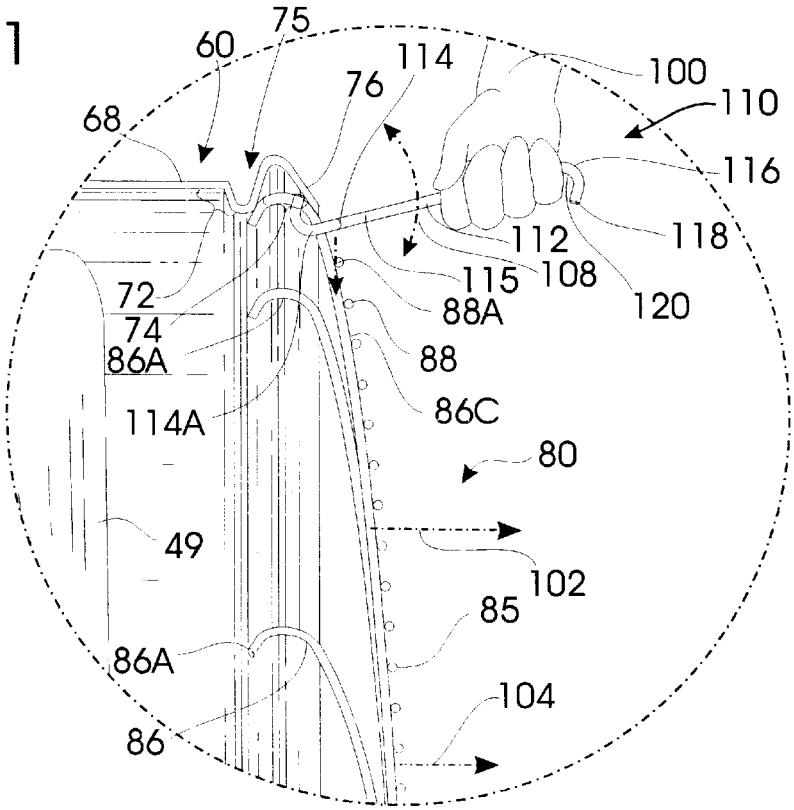
FIG. 11 is an enlarged view of the encircled portion of FIG. 6 showing the guard secured by the lip with the installation tool removed from the lip.
Figure 12:
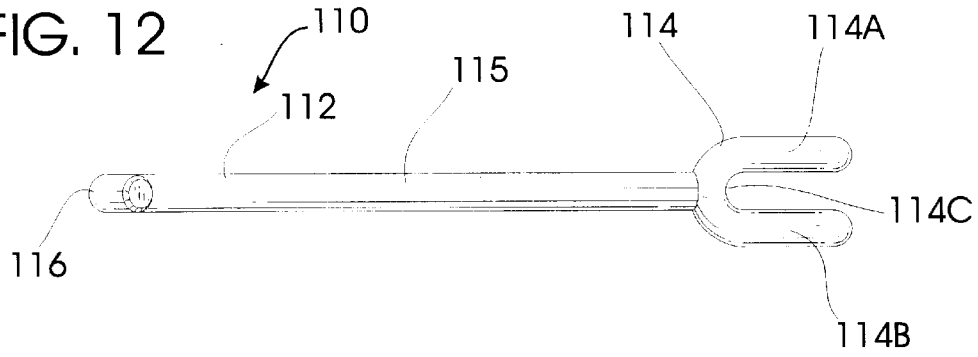
FIG. 12 is a top plan view of the preferred tool for removing and installing guards.
Figure 13:
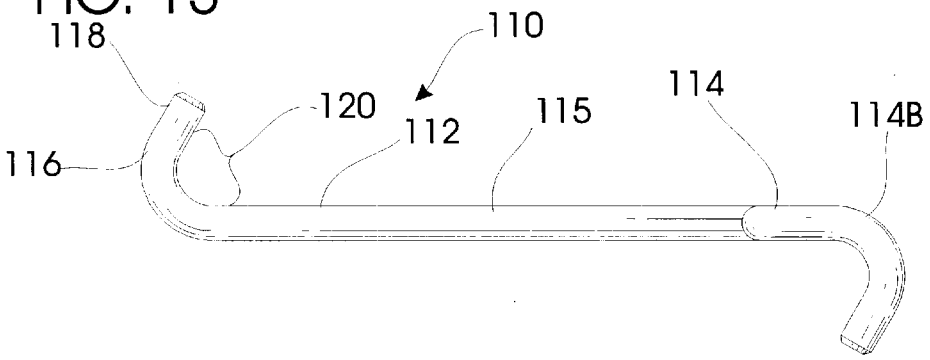
FIG. 13 is a side elevational view of the preferred tool, with the opposite side being a mirror image thereof.
Figure 14:
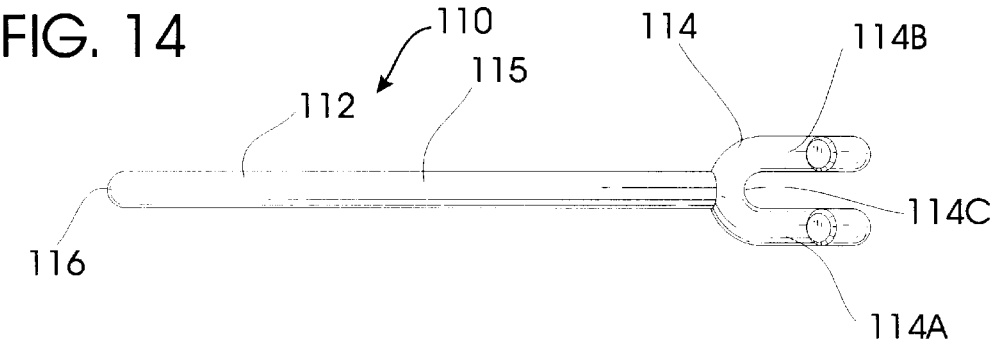
FIG. 14 is a bottom plan view of the preferred tool.
Figure 15:
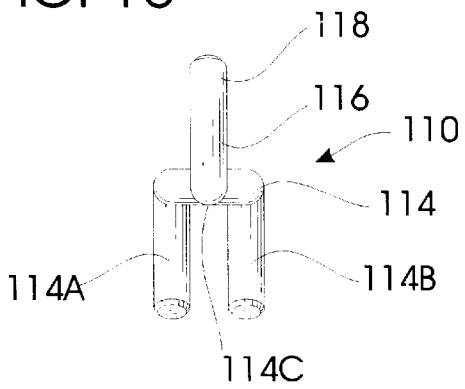
FIG. 15 is an end elevational view taken generally from the hooked end; and, FIG. 16 is an end elevational view taken generally from the forked end and opposite FIG. 15.
Figure 16:
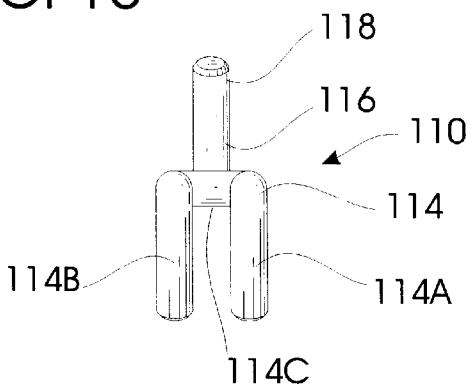

The preferred housing 30 comprises a tubular body that forms a cylinder. Preferably it is rolled from a flat plate into a cylindrical shape to form hollow body 60. The body 60 separates the air input end 32 from the air output end 34. A reinforcing groove 70 circumferentially extends along the body at each end 32, 34. The reinforcing groove 70 is generally S-shaped, and angles away from the body through a pair conjunctive angles 72, 74 (FIGS. 9, 11). The groove receives the guards. Each groove 70 initially angles toward the inside of the housing and outwardly from the body at angle 72, approximately forty-five degrees. A subsequent angle 74, approximately ninety degrees, reverses and then returns the edge to a spaced-apart but parallel location. The two angles symmetrically cooperate during body rolling to help produce consistent cylindrical housings. Since the angles 72, 74 are offset, they counterbalance each other during shaping to maintain the flatness of the plate.

Figure 10:
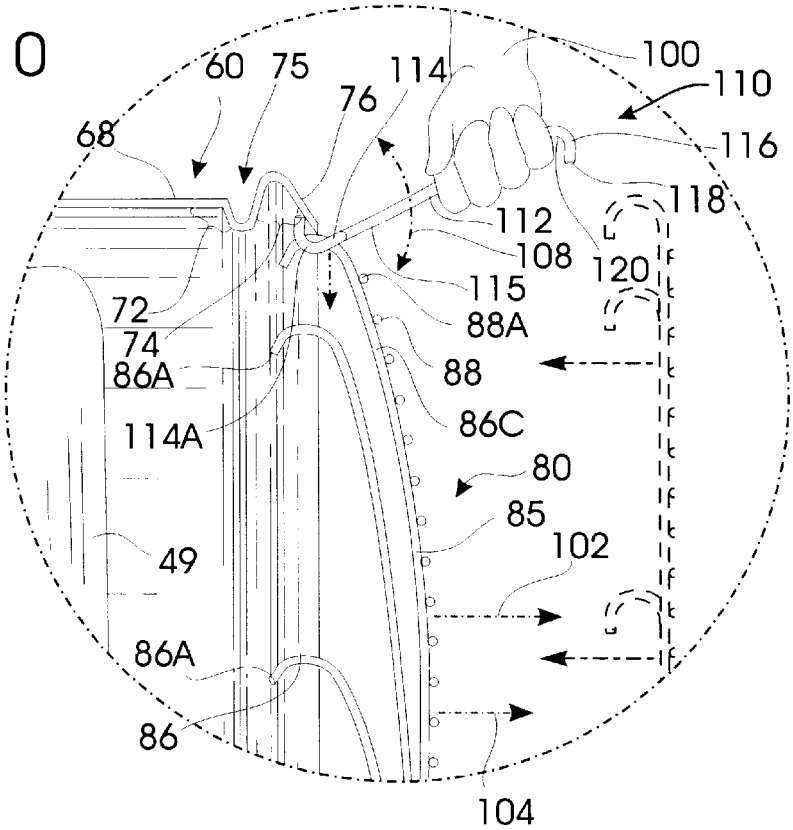
FIG. 10 is an enlarged view of the encircled portion of FIG. 6 showing the guard against the lip with the installation tool positioned in the lip.

Furthermore, during rolling, the angles 72, 74 ensure that the ends of the rolled plate match properly to form the cylinder. An outer channel 75 defines angle 72. The V-shaped peripheral lip 76 that normally retains the seated guard 82 (FIGS. 6 and 8) forms an angle 74. A guard 80 may be unseated from lip 76. Unseated guard 80 may then be removed from fan 20 (FIG. 9). Each guard 80 may also be reseated when desired (FIGS. 10–11). The installation and removal of guard 80 from fan 20 will be more fully discussed hereinafter.

A preferred guard 80 comprises a circular wire frame 85 that presents a convex outer surface. Frame 85 comprises a series of radially spaced-apart spokes 86 emanating from a central hub 90. Guard reinforcement is provided by a wire means 88 in the form of a spiral wound about hub 90, extending between spokes 86. Alternatively multiple concentric rings could be used for reinforcement. Spiral 88 is generally centered about hub 90. An outermost ring-like portion 88A of the spiral 88 borders the periphery of guard 80. Each spoke outwardly terminates in a resilient, arcuate tip 86A. The spoke tips 86A facilitate snap fitting of the guards 80, ultimately seating the guard 80 within channel 70. The wire frame 85 biases the guard 80 outwardly so that it "flexes" or bends about its central hub 90 when forces are exerted either on the spokes 86 or on the spoke tips 86A. To deform the guard for installation, the spokes are thus arched or bent. As a result, the guards snappingly engage the housing 30, and once installed, reinforce the body to maintain concentricity and prevent fan deformation.

When the guards are installed they must be flexed to snap fit within the lower diameter orifice open to them for installing. Prior to installation a typical guard configuration 149 (FIG. 9) has a diameter indicated by arrow 140 that approximately reaches line 141 when uninstalled. The guard spokes must be arched to fit the opening. Configuration 149B has the spokes arched to clear end 143 of the edge structure. Arrow 145 approximately indicates the reduced diameter assumed by the installed guard. At this time the guard tips will be captivated and seated within channel 70. The spokes thus jointly apply force to the periphery of the housing to stress the fan and help preserve the preferred cylindrical shape. The "force fitting" of the guards within the channels 70 also forces the guards to become convex, as the spokes must arch to "clear" the aforementioned dimensions. After installation, the resilient spokes tension the housing as they seek to return to their original orientation. This accumulated, radially spaced apart and uniformly directed static force upon both ends of the housing tends to preserve the preferred cylindrical shape. In turn, this maintains internal alignment, prevents vibrations, and preserves unit integrity.

Guard Removal and Installation

Figure 8:
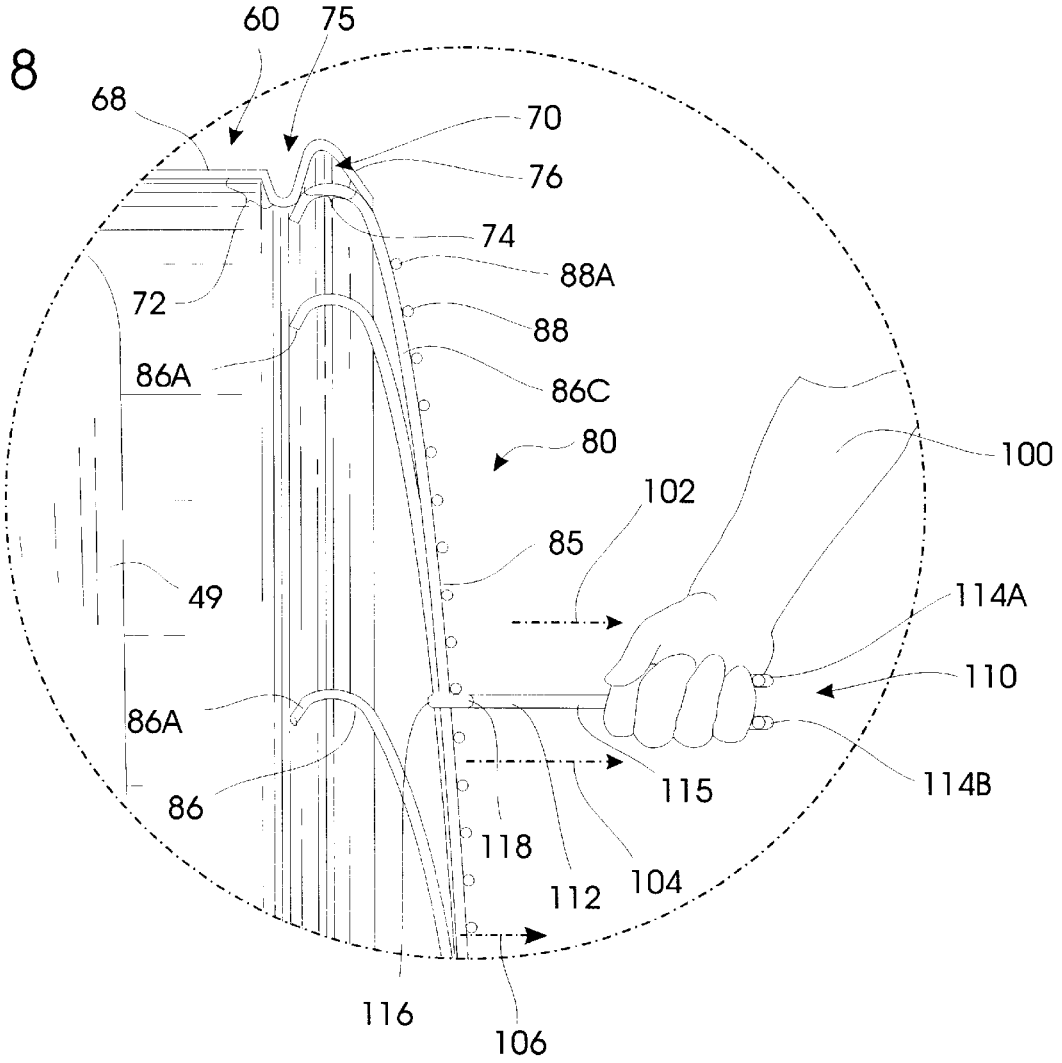
FIG. 8 is an enlarged view of the encircled portion of FIG. 6 showing the guard secured by the lip.

During normal fan operations, the guard 80 remains seated in the channel 75. However, the guard 80 may be conveniently removed from the channel 75 and the housing 30 for fan maintenance or when otherwise necessary (FIGS. 8–9). The guard 80 may then be conveniently reinstalled in channel 75 to prevent objects from contacting the internal fan components 40 (FIGS. 10–11).

The guard 80 may be removed from channel 75 by an operator 100 (FIGS. 8–9). Operator 100 first firmly grips a selected spoke 86C. Any conventional tool may be used to grip the selected spoke 86C, but a preferred tool 110 is discussed hereinafter. The operator 100 then exerts an abrupt outward force 102 on spoke 86C near the central hub 95. This "yanking" force 102 causes the central hub 90 to flex outwardly as shown by arrow 104.

The radial spokes 86 flex or bend as shown by arrow 106 when the central hub 90 moves outwardly. This bending movement permits the spoke tips 86A to move out of their seated positions. Once all of the spoke tips 86A clear the retaining lip 76, the guard 80 may be removed from the fan housing 30.

The guard 80 may be reseated in a similar manner (FIGS. 10–11). Operator 100 first seats several of the spoke tips 86A in lip 76. Then, a downward force 108 is exerted on each unseated spoke tip 86A to bend the guard 80 about its hub 90. Again, the spokes 86 flex about the central hub 90 as it moves outwardly as shown by arrow 104 to permit forcible, snapping insertion of each unseated spoke tip. Tool 110 comprises an elongated shaft 112 having spaced-apart ends. An intermediary handle 115 separates a forked end 114 from a hooked end 116. Preferably, the forked end 114 is split into tines 114A, 114B. Each tine 114A, 114B is similar in shape to hooked end 116. In the preferred embodiment, hooked end 116 comprises a hook 118 approximately one inch in length that forms an angle 120 with shaft 112. Angle 120 is approximately 65 degrees to facilitate insertion of the hook 118 into guard 80.

During guard removal, the hooked end 116 is inserted into guard 80 around spoke 86C near central hub 90. Then, yanking force 102 is exerted by operator 100 to remove guard 80. To install and reseat guard 80, several spoke tips 86A are first seated in lip 76. Then, the forked end 114 is inserted into lip 76 and a spoke tip 86A is inserted beneath the tine juncture 114C. Tip 86A is then forced downwardly to flex guard 80 about its hub 90 while tip 86A is forcibly seated against lip 76.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A tube axle ventilation fan comprising:

an elongated, tubular, housing comprising an outer cylindrical periphery, an interior, an air intake end, a spaced apart air output end, and groove-like reinforcing channels circumscribing said housing intake end and said output end and facing said interior, said housing having a predetermined diameter;

a propeller disposed within said housing;

motor means for rotating the propeller;

a pair of guards for reinforcing the fan, each guard transformable from a generally flat, unstressed and uninstalled configuration comprising a guard diameter greater than said housing predetermined diameter to an installed, stressed, convex orientation comprising a reduced guard diameter, each guard comprising a center and a plurality of radially spaced-apart, resilient, spokes emanating outwardly from said center for applying force to the periphery of said housing to stress the fan and preserve the cylindrical shape thereof when said guards are installed, each of said spokes terminating in tips forcibly captivated within a reinforcing channel when the guard is installed thereby tensioning the spokes and maintaining the convex shape of the guard.

2. A tube axle ventilation fan comprising:

an elongated, tubular, housing comprising an outer cylindrical periphery, an interior, an air intake end, a spaced apart air output end, and groove-like reinforcing channels circumscribing said housing intake end and said output end and facing said interior, said housing having a predetermined diameter;

a propeller disposed within said housing;

motor means for rotating the propeller;

belt means for coupling the motor means to the propeller; and, a pair of guards for reinforcing the fan, each guard transformable from a generally flat, unstressed and uninstalled configuration comprising a guard diameter greater than said housing predetermined diameter to an installed, stressed, convex orientation comprising a reduced guard diameter, each guard comprising a hub and a plurality of radially spaced-apart, resilient, spokes emanating outwardly from said hub for applying force to the periphery of said housing to stress the fan and preserve the cylindrical shape thereof when said guards are installed, each of said spokes terminating in tips forcibly captivated within a housing reinforcing channel when the guard is installed thereby tensioning the spokes and maintaining the convex shape of the guard.

3. A ventilation fan comprising:

an elongated, tubular, housing comprising an outer cylindrical periphery, an interior, an air intake end, a spaced apart air output end, and groove-like reinforcing channels circumscribing said housing intake end and said output end and facing said interior, said housing having a predetermined diameter;

a propeller disposed within said housing;

motor means for rotating the propeller;

a pair of guards snap-fitted to the fan housing, each guard transformable during installation from a generally flat, unstressed configuration comprising a guard diameter greater than said housing predetermined diameter to an installed, stressed, convex orientation comprising a reduced guard diameter, wherein each guard comprises:

a central hub;

a plurality of radially spaced-apart, resilient spokes for tensioning the guards and arching into said convex shape during installation, said spokes emanating outwardly from said hub, each of said spokes terminating in tips that resiliently snap-fit to one of said groove-like, reinforcing channels circumscribing said air intake end and said air output end of said housing; and, wherein the fan is strengthened by the guards in response to arching and tensioning of said spokes when the spoke tips are all forcibly seated within said channels.

* * * * *